US008176955B2

(12) United States Patent
Maietta et al.

(10) Patent No.: US 8,176,955 B2
(45) Date of Patent: May 15, 2012

(54) DISK FLAKER KNIFE ASSEMBLY

(75) Inventors: Anthony Maietta, Worcester, MA (US); Timothy House, Langley, CA (US)

(73) Assignee: Simonds International Corporation, Fitchburg, MA (US)

( * ) Notice: Subject to any disclaimer, the term of this patent is extended or adjusted under 35 U.S.C. 154(b) by 236 days.

(21) Appl. No.: 12/617,762

(22) Filed: Nov. 13, 2009

(65) Prior Publication Data

US 2011/0114222 A1 May 19, 2011

(51) Int. Cl.
*B27C 1/00* (2006.01)

(52) U.S. Cl. ..... 144/176; 144/218; 144/220; 144/235; 241/92

(58) Field of Classification Search ..... 144/162.1, 144/176, 218, 221, 220, 230, 235; 241/92, 241/296, 294, 298
See application file for complete search history.

(56) References Cited

U.S. PATENT DOCUMENTS

| | | | | |
|---|---|---|---|---|
| 2,093,874 A | | 9/1937 | Stargardter | |
| 2,388,799 A | | 11/1945 | Payzer et al. | |
| 3,315,548 A | | 4/1967 | Anderson et al. | |
| 3,600,816 A | | 8/1971 | Watanabe et al. | |
| 3,854,511 A | | 12/1974 | Maier | |
| 4,232,096 A | | 11/1980 | Franzen et al. | |
| 4,298,044 A | * | 11/1981 | Hansel et al. | 144/176 |
| 4,660,777 A | | 4/1987 | Schaefer et al. | |
| 4,750,387 A | | 6/1988 | Swiger | |
| 4,771,718 A | * | 9/1988 | Carpenter et al. | 144/176 |
| 4,784,337 A | | 11/1988 | Nettles et al. | |
| 4,850,408 A | * | 7/1989 | Carpenter et al. | 144/241 |
| 4,997,018 A | * | 3/1991 | Carpenter et al. | 144/241 |
| 5,129,437 A | | 7/1992 | Nettles et al. | |
| 5,333,659 A | | 8/1994 | Carpenter et al. | |
| 5,417,263 A | | 5/1995 | Jorgensen | |
| 5,456,300 A | * | 10/1995 | Rosenkranz et al. | 144/230 |
| 5,469,902 A | | 11/1995 | Sharp et al. | |
| 5,485,873 A | | 1/1996 | Crammond | |
| 5,649,579 A | | 7/1997 | Kokko et al. | |
| 5,819,826 A | | 10/1998 | Schmatjen | |

(Continued)

FOREIGN PATENT DOCUMENTS

| | | |
|---|---|---|
| DE | 1926777 A1 | 11/1970 |
| DE | 2405465 A1 | 8/1975 |
| DE | 3517539 A1 | 11/1986 |

(Continued)

OTHER PUBLICATIONS

Alliance Knife, Inc., Materials List, retrieved from the Internet on Dec. 19, 2007, URL: http://www.allianceknife.com/Products/Materials/materials.html, 1 page.

*Primary Examiner* — Shelley Self
(74) *Attorney, Agent, or Firm* — Mirick, O'Connell, DeMallie & Lougee, LLP

(57) ABSTRACT

A knife assembly includes a knife blade and a mounting assembly having a knife blade support portion extending along a longitudinal axis of the mounting assembly. The knife blade support portion is constructed and arranged to position a cutting edge of the knife blade distal to a leading edge of the mounting assembly. The mounting assembly also has a counter knife portion disposed at the leading edge of the mounting assembly that defines a set back distance with the knife blade. The set back distance is constructed and arranged to provide a travel path for a wafer.

18 Claims, 9 Drawing Sheets

U.S. PATENT DOCUMENTS

| | | | | |
|---|---|---|---|---|
| 5,820,042 | A * | 10/1998 | Robison | 241/92 |
| 6,484,770 | B1 | 11/2002 | Jonkka | |
| 6,701,627 | B2 | 3/2004 | Korb et al. | |
| 6,757,952 | B1 | 7/2004 | Stager | |
| 6,811,362 | B2 | 11/2004 | Wallin et al. | |
| 6,918,419 | B2 | 7/2005 | Wixey et al. | |
| 6,953,167 | B2 * | 10/2005 | Strong | 241/92 |
| 2004/0250899 | A1 | 12/2004 | Pallmann | |
| 2009/0217794 | A1 | 9/2009 | Maietta et al. | |

FOREIGN PATENT DOCUMENTS

| | | | |
|---|---|---|---|
| DE | 4013050 | A1 | 10/1991 |
| DE | 19500408 | A1 | 7/1996 |
| DE | 19509664 | A1 | 9/1996 |
| EP | 0924039 | A2 | 6/1999 |
| EP | 1325798 | A1 | 7/2003 |
| GB | 2324499 | A | 10/1998 |
| WO | 2007053332 | A1 | 5/2007 |

* cited by examiner

DISK FLAKER KNIFE ASSEMBLY

BACKGROUND

Oriented strand board (OSB) is a wood product formed from layered wafers of wood oriented in a particular pattern. For example, conventional OSB includes top and bottom layers of wood wafers with the longitudinal axes of the wafers aligned substantially parallel to a longitudinal axis of the board. Conventional OSB also includes a central layer disposed between the top and bottom layers with the longitudinal axes of wafers aligned substantially perpendicular to the longitudinal axis of the board.

As part of the OSB manufacturing process, manufacturers utilize waferizing machinery, such as ring strander devices or disk flaker devices to shave logs, such as aspen, yellow pine, or white birch, into thin wafers in a procedure termed waferizing. Taking disk flaker devices as an example, a typical disk flaker device includes a rotating disk and a set of knife assemblies supported by the rotating disk where each knife assembly extends from a center of rotation of the disk to an outer periphery of the disk. Each knife assembly includes a knife blade that extends toward a work piece, such as one or more logs, where a longitudinal axis of each log is substantially parallel to a face of the rotating disk. In such an arrangement, during operation, as the rotating disk rotates about its center of rotation and as the logs advance toward the rotating disk (or as the rotating disk advances toward the logs), the cutting assemblies shaves wood from the logs and a counter knife of each cutting assembly causes the shavings to break into wood wafers having a particular range of widths. These wood wafers are then used in the manufacture of OSB.

SUMMARY

During operation of the conventional disk flaker device, the knife blades of the knife assemblies become worn and, as a result, cannot effectively form the wood wafers. Accordingly, disk flaker operators must change the knife blade of each knife assemblies multiple times per day. For example to change a knife assembly in a conventional disk flaker device, an operator first removes a clamp plate from a face gear of the disk flaker's rotating disk to expose the knife assembly. Next, because the counter knife and the knife blade of the conventional knife assembly are fastened together, the operator removes the knife assembly from the face gear. The operator then places the clamp plate in contact with the replacement knife assembly and couples the clamp plate to the face gear to secure the knife assembly to the disk flaker device. The operator can then transfers the worn knife assemblies to a grinding area for resharpening of the knife blade.

Conventional knife assemblies as used in disk flaker device, however, suffer from a variety of deficiencies. Typically, the knife blade and the corresponding counter knife of each knife assembly are secured together using a series of fasteners. Accordingly, during a replacement procedure, each knife assembly in its entirety must be removed from the disk flaker device. However, each knife assembly weighs about 25 pounds, thereby making replacement of the worn knife assemblies a cumbersome process to the operator. Additionally, because the knife assemblies are relatively heavy, the replacement process can be time intensive causing the disk flaker device to be inoperative for several hours.

Alternates to conventional knife assemblies have been utilized in the OSB manufacturing process. For example, certain manufacturers have utilized keyed chipper knives, as produced by Key Knife Inc. (Key Knife Inc., Portland Oreg.) and as shown in U.S. Pat. No. 5,819,826, to form wood wafers in the OSB manufacturing process. The keyed chipper knives are relatively lightweight and can be replaced in the disk flaker device. However, the key chipper knives do not include counter knives or appropriate counter knife geometry. Accordingly, during the shaving process, the keyed chipper knives can generate oversized wood wafers (i.e., termed postcards) that are unusable in the manufacture of OSB. Additionally, the keyed chipper knives can generate a relatively large amount of waste wood particles or fines as a result of inefficient formation of the wood wafers, thereby minimizing the amount of usable wood wafers formed in the waferizing process.

By contrast to conventional cutting assemblies such as used in disk flaker devices, embodiments of the present invention relate to a disk flaker knife assembly that includes a mounting assembly and a removable knife blade carried by the mounting assembly. The mounting assembly is secured to a face gear of a disk flaker device and supports the knife blade to allow a leading edge of the knife blade to contact a work piece during operation of the disk flaker device. The mounting assembly also includes a counter knife portion configured to break wood shavings generated by the knife blade into wood wafers having a particular range of widths. A clamp plate of the disk flaker device secures the knife blade to the mounting assembly. With such a configuration of the knife assembly, as the knife blade becomes dull, an operator can easily replace the knife blade in the knife assembly without having to remove the entire knife assembly from the disk flaker device. Accordingly, use of the knife assembly can reduce the amount of time required to replace the knife blade, thereby reducing disk flaker device downtime.

In one arrangement, a knife assembly includes a knife blade and a mounting assembly having a knife blade support portion extending along a longitudinal axis of the mounting assembly. The knife blade support portion is constructed and arranged to position a cutting edge of the knife blade distal to a leading edge of the mounting assembly. The mounting assembly also has a counter knife portion disposed at the leading edge of the mounting assembly that defines a set back distance with the knife blade. The set back distance is constructed and arranged to provide a travel path for a wafer.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Embodiments of the present invention relate to a disk flaker knife assembly that includes a mounting assembly and a removable knife blade carried by the mounting assembly. The mounting assembly is secured to a face gear of a disk flaker device and supports the knife blade to allow a leading edge of the knife blade to contact a work piece during operation of the disk flaker device. The mounting assembly also includes a counter knife portion configured to break wood shavings generated by the knife blade into wood wafers having a particular range of widths. A clamp plate of the disk flaker device secures the knife blade to the mounting assembly. With such a configuration of the knife assembly, as the knife blade becomes dull, an operator can easily replace the knife blade in the knife assembly without having to remove the entire knife assembly from the disk flaker device. Accordingly, use of the knife assembly can reduce the amount of time required to replace the knife blade, thereby reducing disk flaker device downtime.

Figure 1:
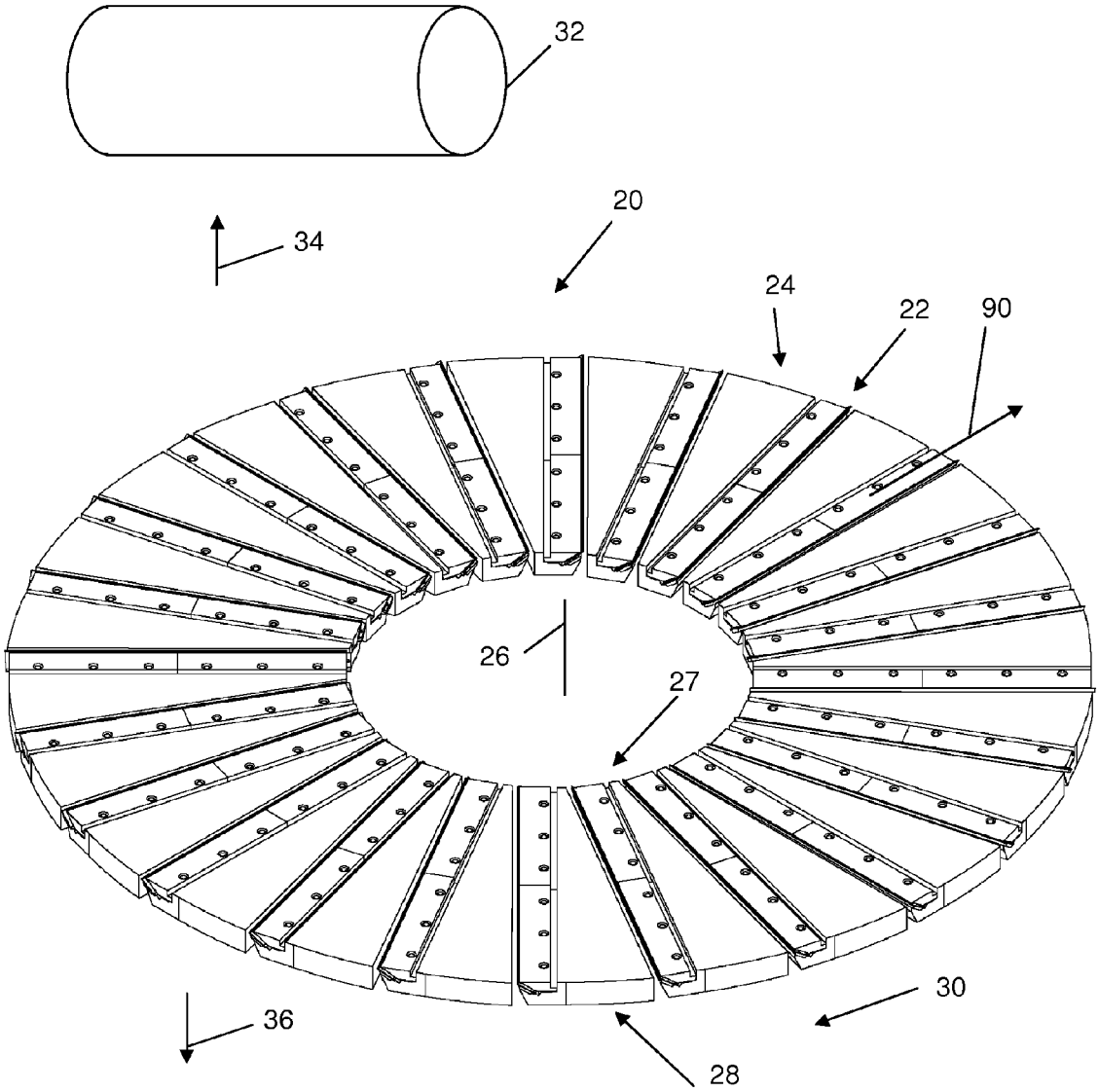
FIG. 1 illustrates a schematic representation of a cutting face of a disk flaker device, the cutting face having a set of knife assemblies.
Figure 2:
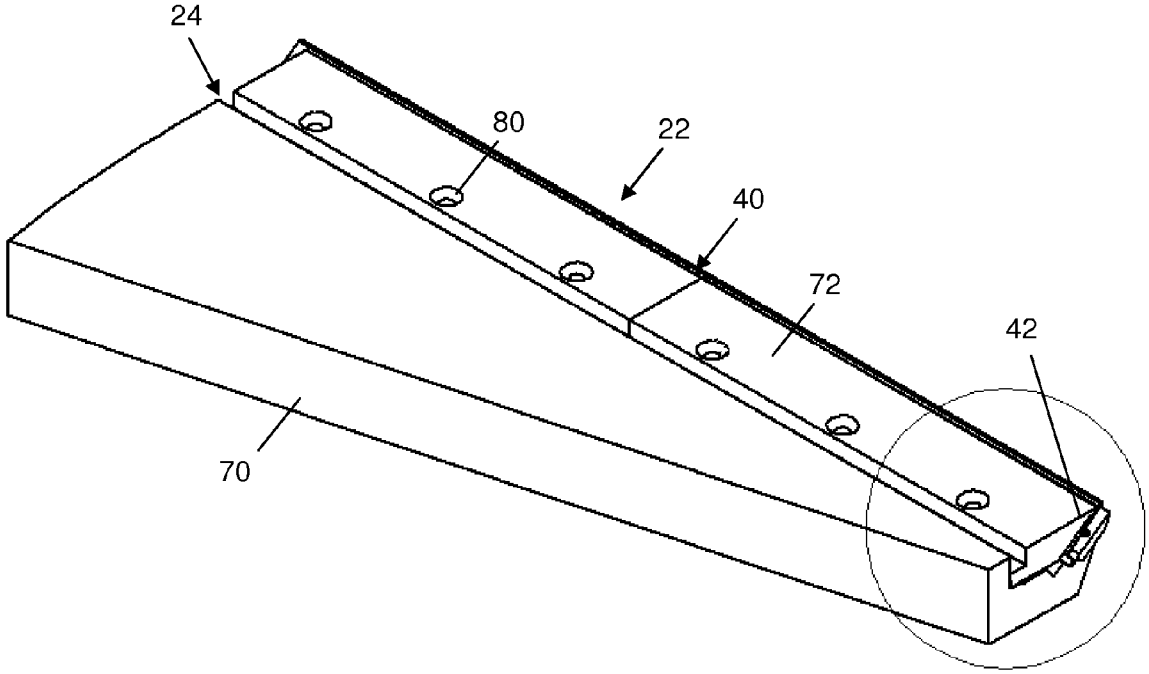
FIG. 2 illustrates a perspective view of a knife assembly of FIG. 1 as secured to a face gear of a disk flaker device via a clamp plate.
Figure 3:
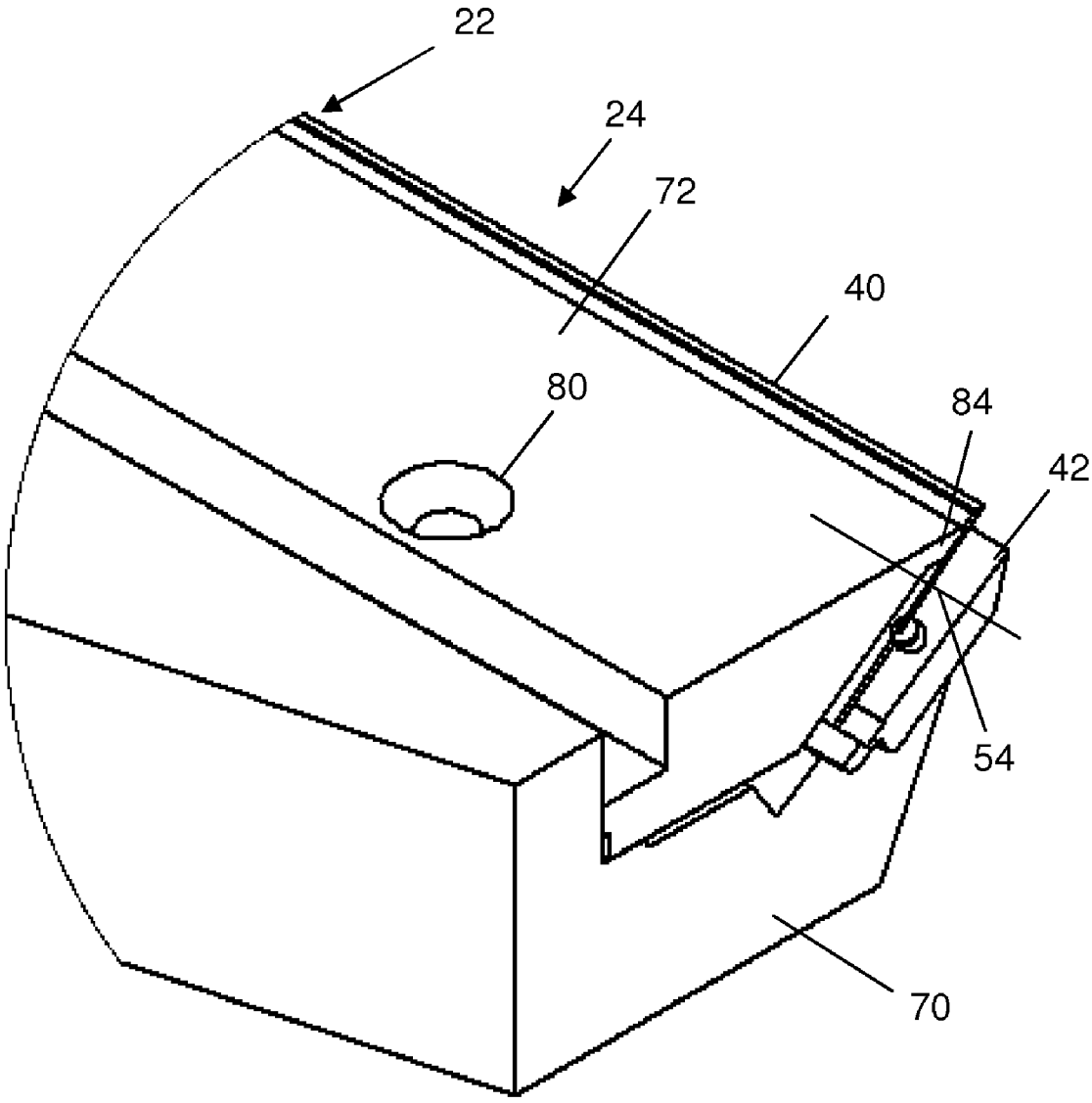
FIG. 3 illustrates an end perspective view of the knife assembly, face gear, and clamp plate of FIG. 2.
Figure 4:
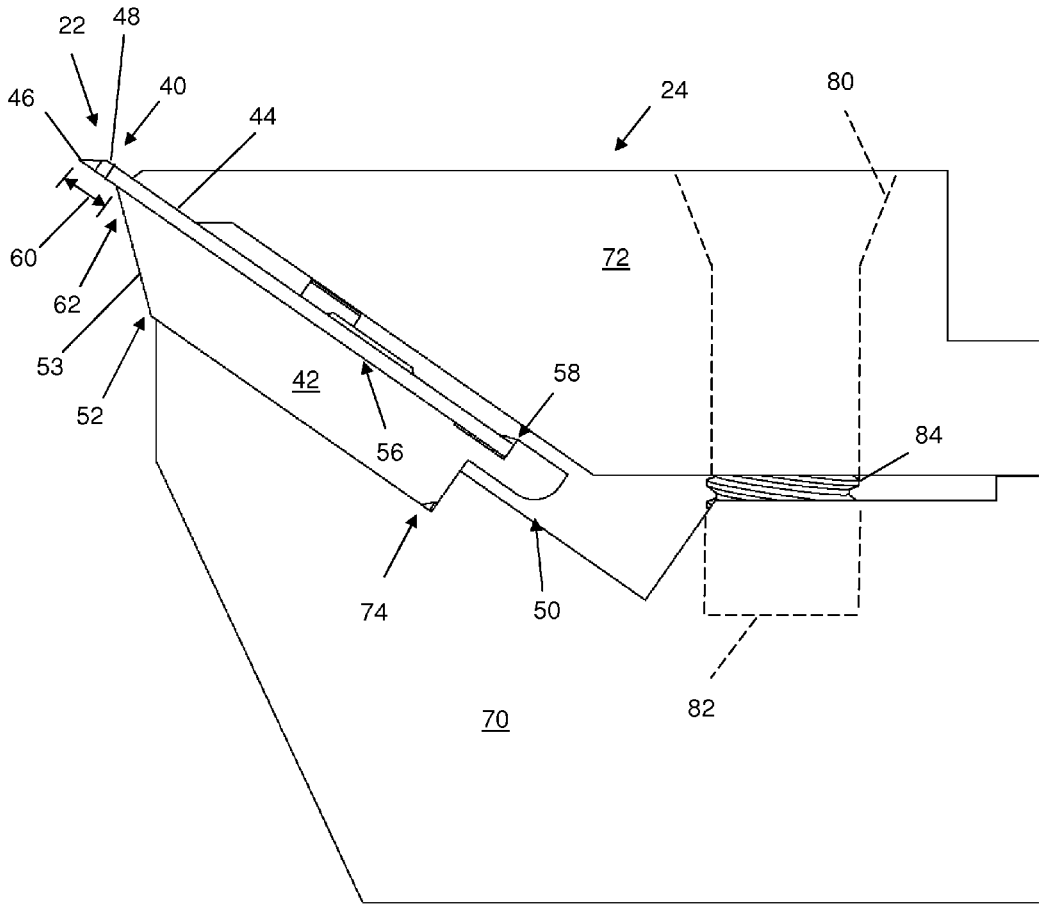
FIG. 4 illustrates an end view of the knife assembly, face gear, and clamp plate of FIG. 2.

FIG. 1 illustrates a rotating disk 20 of a disk flaker device, the rotating disk 20 having a set of knife assemblies 22 and a corresponding set of knife assembly securing mechanisms 24 that secure the knife assemblies 22 to the disk flaker device. Knife edges of each knife assembly 22 extend along respective radii of the rotating disk 20, from a center of rotation 26 to an outer periphery 28 of the rotating disk 20. During operation, as a disk flaker motor (not shown) rotates the rotating disk 20 about the center of rotation 26 in a clockwise direction 30, the knife assemblies 22 shave logs, such as aspen or white birch, into thin wafers in a procedure termed waferizing. For example, in one arrangement, the disk flaker device advances the rotating disk 20 along direction 34 toward a log pack 32. As the knife assemblies 22 contact the log pack, the knife assemblies 22 generate wood wafers which exit the rotating disk 20 along direction 36. While a total of twenty-four knife assemblies 22 are illustrated as forming part of the rotating disk 20, it should be understood that any number of knife assemblies 22 can be used.

Each knife assembly 22 is configured to allow removal and replacement of a knife blade held by the knife assembly 22 without requiring an operator to remove the entire knife assembly 22 from the rotating disk 20. Details of the components of the knife assembly 22 and knife assembly securing mechanisms 24 are provided below.

As illustrated in FIGS. 2-5, each knife assembly 22 includes a knife blade 40 and a mounting assembly 42. In the arrangement illustrated, the knife blade 40 is formed as a bi-metal material. For example, with specific reference to FIGS. 4 and 5, the knife blade 40 includes a body portion 44 formed of a first material and a cutting or edge portion 46 formed of a second material and disposed along an edge of the body portion 44. While the body portion 44 can be formed from a variety of materials, in one arrangement, the body portion 44 is formed of a material having relatively high fatigue-resistance properties. For example, the body portion 44 can be formed from a medium carbon, low alloy steel, such as D6A, 6135 steel, or 6150 steel having a hardness of between about 42 and 48 HRC. Additionally, while the edge portion 46 can be formed from a variety of materials, in one arrangement, the edge portion 46 is formed from a material having relatively high wear-resistance properties. For example, the edge portion 46 can be formed from a high-speed steel material such as high-speed steel material M42 having a hardness of at least about 60 HRC and, in one arrangement, between about 63 and 70 HRC. The high-speed steel material helps to minimize wear of the knife blade 40 when used during the waferizing process.

The knife blade 40 includes a weld zone 48 disposed between the body portion 44 and the edge portion 46. For example, during the manufacturing process, an assembler secures the high-speed steel edge portion 46 to the body portion 44 using a welding technique, such as an electron beam welding technique. During the welding process, the high-speed steel edge portion 46 and the body portion 44 enter a lead lined vacuum chamber where a carbide guide pushes the edge portion 46 and the body portion 44 together. An electron source shoots a beam of electrons at the interface of the body and edge portions 44, 46. The friction of the electrons passing between the portions 44, 46 heats the materials to melting temperatures and fuses the body and edge portions 44, 46 together at an interface termed the weld zone. The weld zone maintains the coupling of the body and edge portions 44, 46 during use of the knife blade 40. Once welded together, the assembler then grinds a bevel into the edge portion 46 of the knife blade 40. While an electron beam welding technique is described as being used to join the high-speed steel edge portion 46 and the body portion 44, alternate joining techniques can be used as well. For example, any form or welding or a permanent adhesive can be used to join the high-speed steel edge portion 46 and the body portion 44.

The mounting assembly 42 is configured to both support the knife blade 40 within the disk flaker device and to aid in breaking wood chips, as generated by the knife blade 40, into wood wafers having a particular range of widths. Accordingly, in one arrangement and with reference to FIGS. 4-6, the mounting assembly 42 includes a knife blade support portion 50 and a counter knife portion 52 disposed at the leading edge of the mounting assembly 42.

The knife blade support portion 50, as defined by the mounting assembly 42 extends along a longitudinal axis 54 of the mounting assembly 42. In one arrangement, the knife blade support portion 50 includes a knife blade body support portion 56 and a knife blade base support portion 58. The knife blade body support portion 56 is configured to support body portion 44 of the knife blade 40 to minimize deflection or bending of the knife blade 40 during a cutting procedure. The knife blade base support portion 58 is configured to position the edge portion 46 of the knife blade 40 relative to the knife assemblies 22 such that the edge portion 46 extends beyond a leading edge of the mounting assembly 42. Such a configuration allows the edge portion 46 of the knife assembly 22 to contact a work piece, such as a log 32, during operation of the disk flaker device. While the knife blade support portion 50 can be configured in a variety of shapes, in one arrangement, the knife blade support portion 50 is defined as a substantially L-shaped recess formed in the mounting assembly 42 such that the knife blade body support portion 50 is substantially orthogonal to the knife blade base support portion 58.

The counter knife portion 52 is disposed at the leading edge of the mounting assembly 42 and is configured to break wood shavings generated by the knife blade 40 into wood wafers having a particular range of widths. The counter knife portion 52 defines a set back distance 60 with the edge portion 46 of the knife blade 40. While the set back distance 60 can have a variety of lengths, in one arrangement, the set back distance 60 has a length between about 3/16" and 3/8". The counter knife portion 52 includes a face portion 53 that defines an angle 62 relative to a planar surface of the knife blade body support portion 56. For example, in one arrangement the face portion 53 defines an angle 62 of between about 35° and about 65° relative to the planar surface of the knife blade body support portion 56. Both the set back distance 60 and the angle 62 define a travel path for the wood shavings generated by the knife blade 40 which causes the shavings to break into wood wafers or strands having a width of between about 1 inch and 2 inches.

The configuration of the mounting assembly 42 and the knife blade 40 can aid in maximizing wafer flow through the disk flaker device and minimizing plugging of the wood wafers between adjacent knife assembly securing mechanisms 24 in the disk flaker device. For example, in one arrangement, the knife blade 40 is configured as having a thickness of about 0.062 inches. With such a thickness, an operator can easily remove and replace the knife blade 40 within the knife assembly 22. In order to accommodate for such a thickness of the knife blade 40, and in order for the knife blade 40 to be held securely between a conventional face gear 70 and clamp plate 72 of a disk flaker device, the thickness of the counter knife is increased relative to conventional counter knives. For example, while conventional counter knives have a thickness of about 0.062 inches, the counter knife portion 52 of the mounting assembly 42 is configured with a thickness of about 0.198 inches. In turn, because of the greater thickness of the counter knife portion 52, the angle 62 can be configured as a relatively shallow angle (i.e., between about 35° and about 65°) relative to the planar surface of the knife blade body support portion 56, as compared to conventional counter knives. Such an angle defines a relatively wide throat opening between the knife assembly 22 and the preceding face gear 70 disposed proximate to a cutting edge of the knife blade 40 of the knife assembly 22. The relatively wide throat opening, compared to conventional disk flaker devices, helps to optimize chip flow through the disk flaker and minimizes plugging of the wood wafers between adjacent knife assembly securing mechanisms 24 in the disk flaker device.

As indicated above, each knife assembly 22 is secured to the disk flaker device with a corresponding knife assembly securing mechanism 24. For example, with reference to FIGS. 2-5, the knife assembly securing mechanism 24 includes a face gear 70 and one or more clamp plates 72.

The face gear 70 is configured to support a corresponding knife assembly 22 within the disk flaker device. For example, the face gear 70 defines a substantially L-shaped recess 74 extending along a longitudinal axis of the face gear 70. The recess 74 is configured to mate with the corresponding geometry of the mounting assembly 42. The face gear 70 also defines a set of openings 76 that interact with a set of coupling mechanisms 78 associated with the mounting assembly 42 to secure the mounting assembly 42 to the disk flaker device. For example, with particular reference to FIG. 5, the mounting assembly 42 defines a set of openings 76 within the knife blade support portion 50 and disposed along the longitudinal axis 54 of the mounting assembly 42. The mounting assembly 42 also includes a set of coupling mechanisms 78, such as threaded fasteners or bolts, which threadably couple to correspondingly aligned openings 76, such as tapped openings, defined by the face gear 70. Accordingly, interaction between the set of coupling mechanisms 78 and the face gear 70 supports and secures the mounting assembly 42 to the disk flaker device.

As indicated above, the knife assembly securing mechanism 24 includes one or more clamp plates 72 are configured to secure the knife blade 40 to the disk flaker device. For example, with reference to FIGS. 2-5, each clamp plate 72 defines a set of openings 80 that align with corresponding openings 82 defined by the face gear 70 of the disk flaker device. Fastening mechanisms 84, such as threaded fasteners or bolts, insert within the corresponding openings 82 and secure the clamp plate 72 to the face gear 70. Once secured, a clamping portion 84 exerts a load against the body portion 44 of the knife blade 40 to secure the knife blade 40 to the face gear 70.

With such a configuration of the knife assembly 22, as the knife blade 40 becomes dull, an operator can easily replace the knife blade 40 in the knife assembly 22 without having to remove the entire knife assembly 22 from the disk flaker device. For example, to replace the knife blade 40, the user first removes or loosens the fastening mechanisms 84 from the clamp plate 72 and face gear 70 openings 80, 82. The user then removes the clamp plates 72 from the face gear 70 to expose and allow removal of the knife blade 40. Because the mounting assembly 42 is secured to the face gear 70 and is used to support the knife blade 40, the user can easily remove the knife blade 40 from the mounting assembly 42. Accordingly, use of the knife assembly 22 can reduce the amount of time required to replace the knife blade 40, thereby reducing disk flaker device downtime while allowing a manufacturer to maintain a suitable geometry of wood wafers for OSB manufacture and minimize creation of dust or fines.

As indicated above, in use, the clamp plate 72 exerts a load against the body portion 44 of the knife blade 40 to secure the knife blade 40 to the face gear 70. However, over time, the coupling mechanisms 84 that secure the clamp plate 72 to the face gear 70 can become loose, resulting in a loss of clamping pressure on the knife blade 40, thereby allowing the knife blade 40 to translate along the longitudinal axis 54 of the mounting assembly 42. For example, in the case of reduced clamping pressure and with reference to FIG. 1, as the disk flaker rotates the disk 20 at relatively high speeds the knife blade 40 can translate along direction 90 and exit the disk flaker device, resulting on possible damage to the knife blade 90. In one arrangement, to minimize such potential damage, the mounting assembly 42 is configured to minimize longitudinal movement of the knife blade 40.

Figure 5:
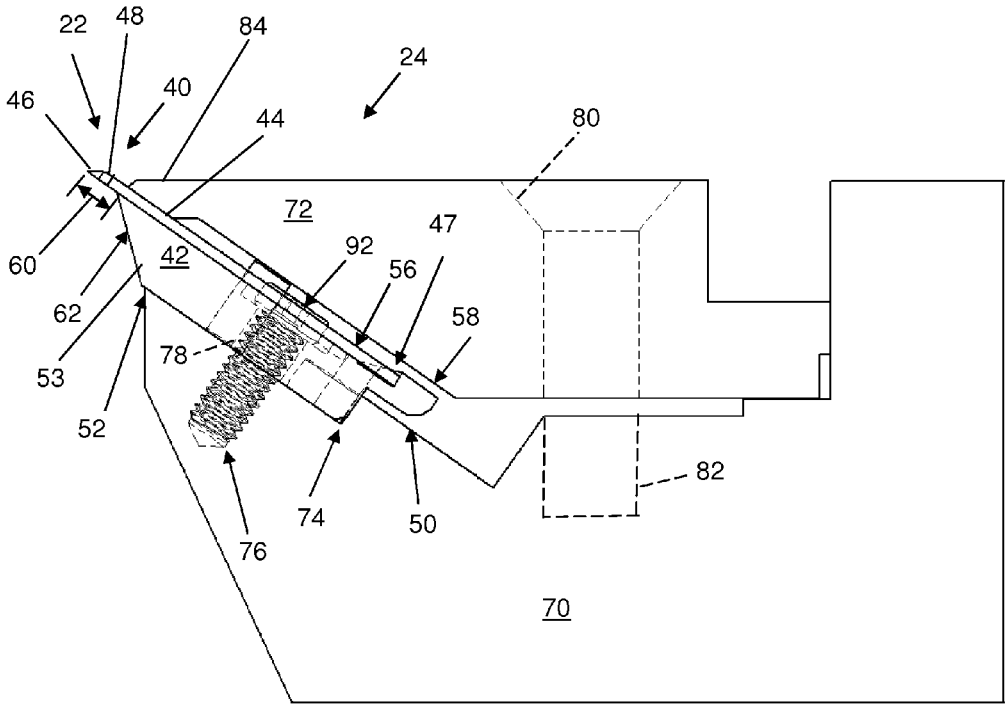
FIG. 5 illustrates an end sectional view of the knife assembly, face gear, and clamp plate of FIG. 2.
Figure 6:
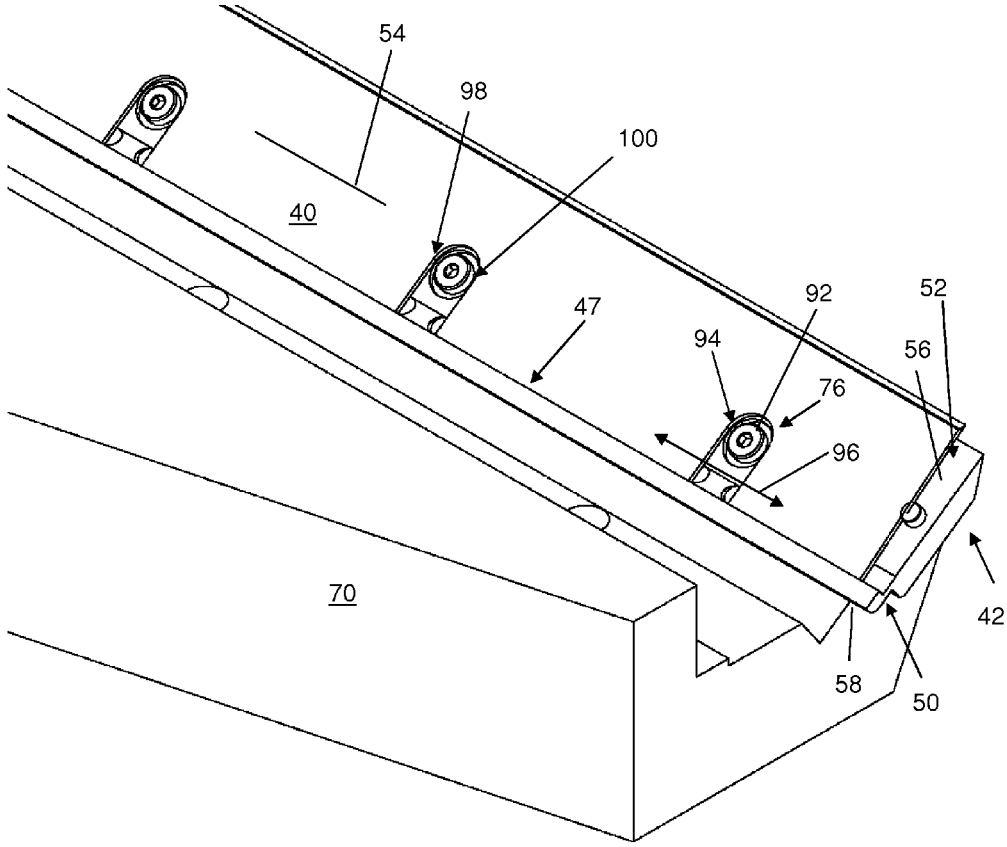
FIG. 6 illustrates a longitudinal support mechanism of the knife assembly of FIG. 2.

As illustrated in FIGS. 5 and 6 and as indicated above, the mounting assembly 42 includes coupling mechanisms 78 that secure the mounting assembly 42 to the face gear 70. In one arrangement, the knife blade 40 interacts with the coupling mechanisms 78 to minimize longitudinal translation of the knife blade 40 during operation. For example, each coupling mechanism 78 includes a head portion 92, at least a part of which extends above a support face of the knife blade support portion 50, as shown. The knife blade 40 defines a set of openings 94 disposed along a longitudinal axis of a knife blade body portion 44. For example, while the knife blade 40 can define any number of openings 94 along the body portion 44, in one arrangement, the knife blade 40 defines at least one opening 94 in the body portion 44 and can define eight or more openings 94.

In the arrangement illustrated, when the mounting assembly 42 supports the knife blade 40, each opening 94 aligns with and at least partially surrounds the head portion 92 of each corresponding coupling mechanism 78. Interaction between the set of openings 94 and the corresponding head portions 92 of the coupling mechanisms 78 limits longitudinal movement 96 of the knife blade 40 relative to the mounting assembly 42. For example, the inner wall defining each opening 94 can substantially contact at least the lateral faces 98, 100 of each head portion 92. Accordingly, in the event that the clamp plates 72 were to provide a reduced clamping pressure to the knife blade 40, such interaction minimizes the possibility of the knife blade 40 exiting the disk flaker device during operation.

The geometry of the set of openings 94 can be configured in a variety of ways. For example, in one arrangement, the openings 94 define a substantially circular geometry. In another arrangement, each opening 94 is configured as a generally slot-shaped opening. For example, as illustrated in FIG. 6, each opening 94 extends from the knife blade body portion 44 to a knife blade base portion 47 to define the slot-shaped opening. With such a slot-shaped geometry, the knife blade 90 can be easily place in, and removed from, the mounting assembly 42.

Returning to FIG. 1 and as indicated above, during operation, the disk flaker motor rotates the rotating disk 20 about the center of rotation 26 in a clockwise direction 30, causing the knife assemblies 22 shave logs into thin wafers. With such rotation, however, the relative linear velocity of the knife assemblies 22 varies along the radii of the rotating disk 20. For example, the linear velocity of the knife assemblies 22 at the outer periphery 28 of the rotating disk 20 is faster than the linear velocity of the knife assemblies 22 at an inner periphery 27. Such a discrepancy of the velocity of the knife assemblies 22 along the length can lead to the generation of non-uniformly sized wood wafers during operation. In one arrangement, the counter knife portion 52 of the mounting assembly 42 is configured to minimize such a discrepancy in the size of the wood wafers produced during operation of the disk flaker device.

As indicated above, the counter knife portion 52 includes a face portion 53 that defines an angle 62 relative to a planar surface of the knife blade body support portion 56. In one arrangement, as illustrated in FIGS. 7-9, the angle 62 defined between the face portion 53 and the planar surface of the body support portion 56 transitions, along the longitudinal axis 54 of the mounting assembly 42, from a first angle 110 at a first end 112 of the mounting assembly 42, as disposed at an outer periphery 28 of the disk 20, to a second angle 114 at a second end 116 of the mounting assembly 44, as disposed at the inner periphery of the disk 20.

Figure 7:
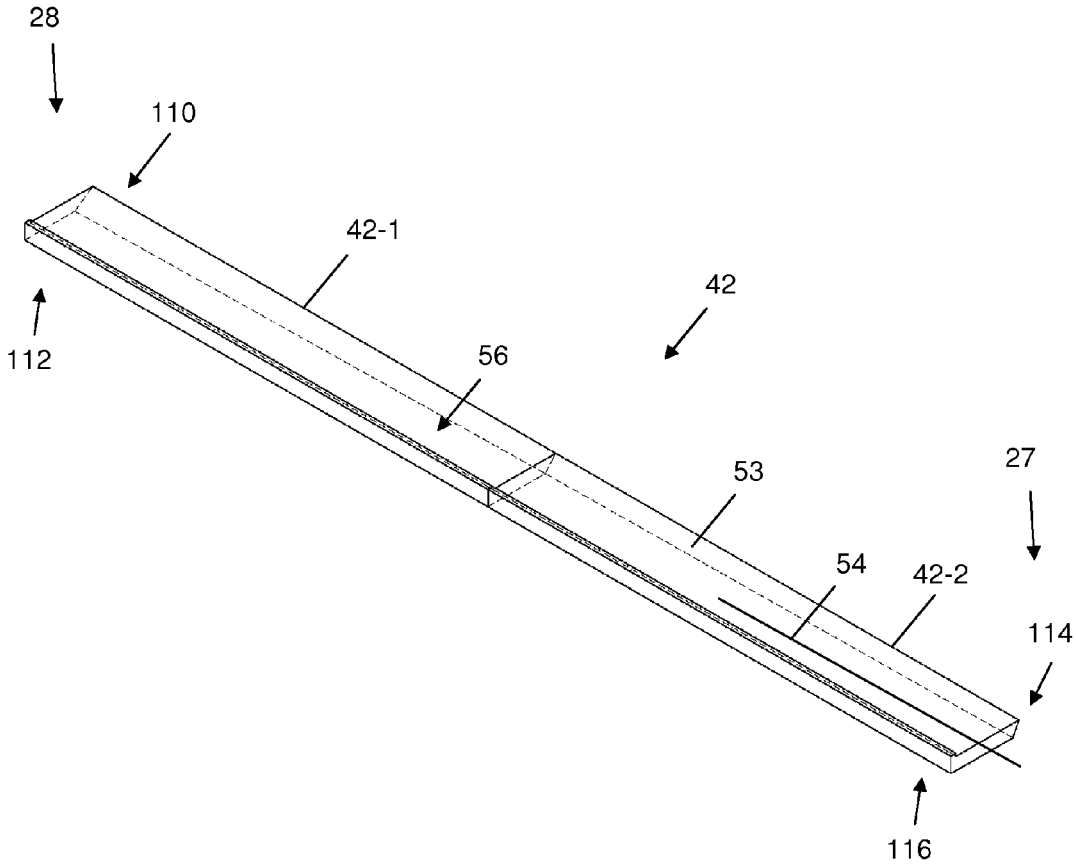
FIG. 7 illustrates a top perspective view of a first and second counter knife of the knife assembly of FIG. 2, the first and second counter knives having a face angle that transitions along a longitudinal axis of the knife assembly.
Figure 8:
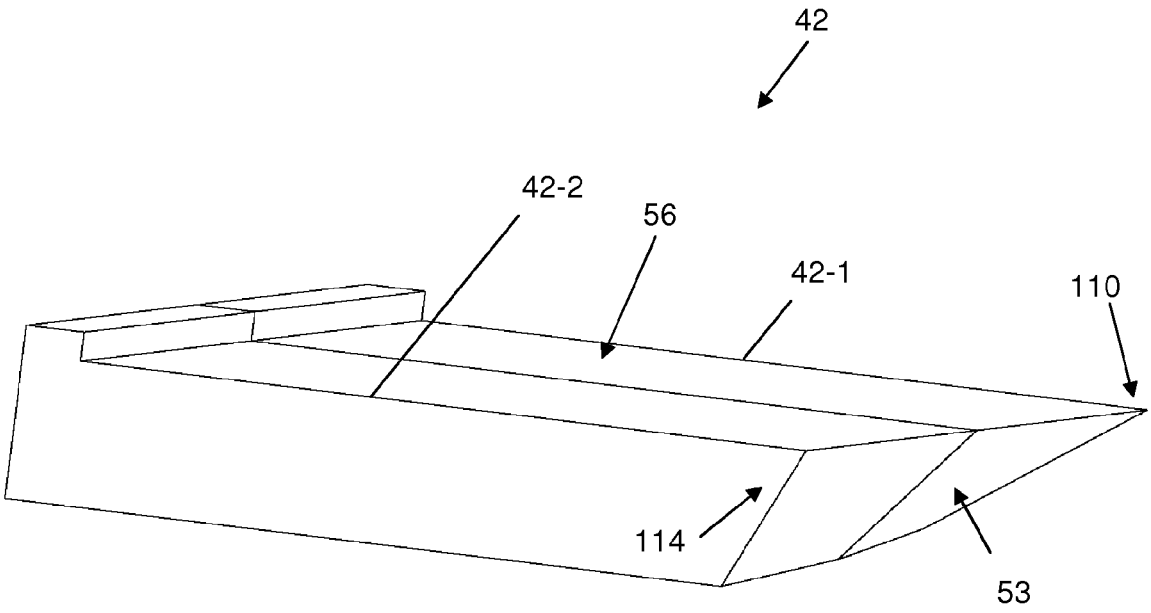
FIG. 8 illustrates a side perspective view of the first and second counter knives of FIG. 7.
Figure 9:
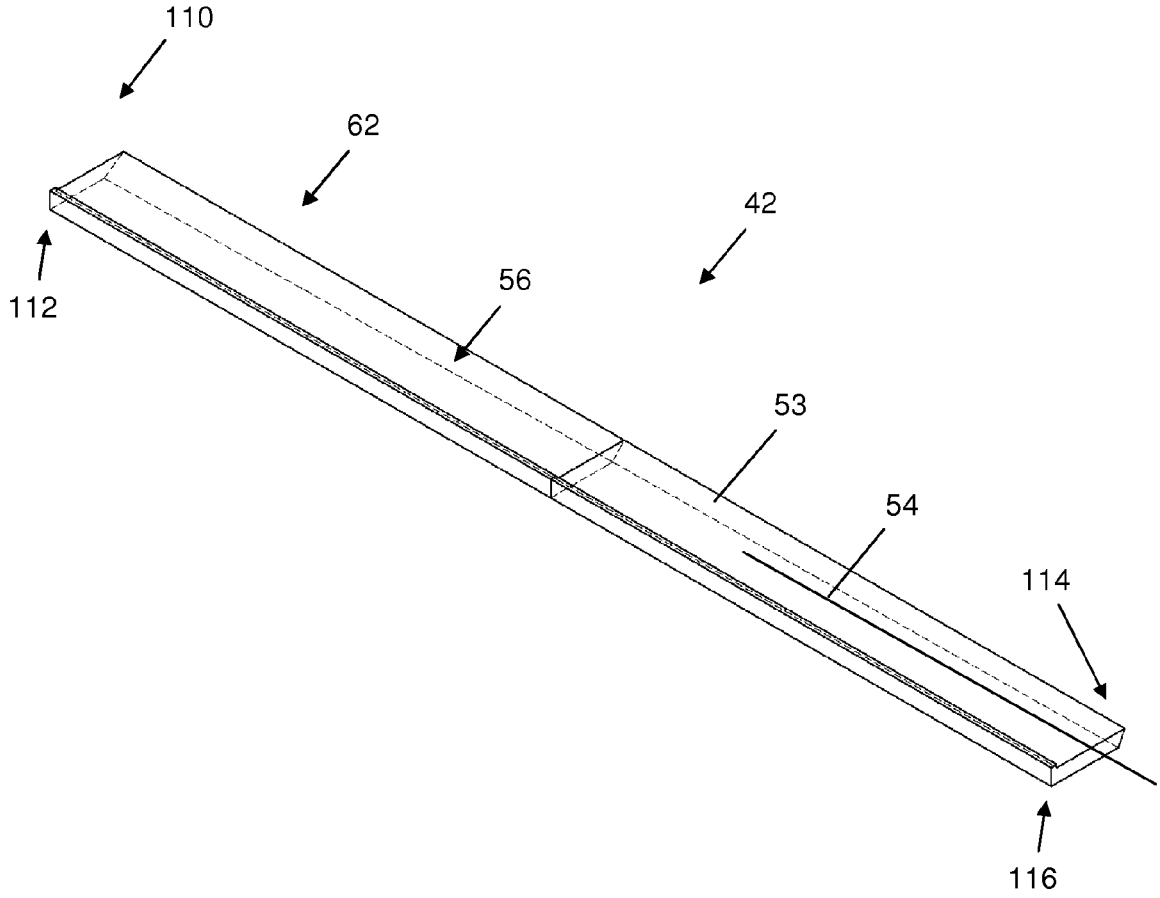
FIG. 9 illustrates a top perspective view of an alternate counter knife of the knife assembly of FIG. 2, the counter knife having a face angle that transitions along a longitudinal axis of the knife assembly.

For example, FIGS. 7 and 8 illustrate a mounting assembly 42 having a first mounting assembly portion 42-1 and a second mounting assembly portion 42-2 mounted within the knife assembly securing mechanisms 24 in a side-by-side manner. In such an arrangement, the angle 62 defined between the face portion 53 and the planar surface of the body support portion 56 of the first mounting assembly portion 42-1 transitions from about 35° at the first end 112 to about 50°. The angle 62 defined between the face portion 53 and the planar surface of the body support portion 56 of the second mounting assembly portion 42-2 transitions from about 50° to about 65° at the second end 116. FIG. 9 illustrates an alternate arrangement of the mounting assembly 42 configured as a continuous piece transitioning where the angle 62 defined between the face portion 53 and the planar surface of the body support portion 56 transitions from about 35° at the first end 112 to about 65° at the second end 116. With such a transitioning in the angle of the counter knife portion along the longitudinal axis 54 of the mounting assembly 42, the counter knife portion 52 is configured to generate substantially uniformly sized wood wafers during operation.

While various embodiments of the invention have been particularly shown and described, it will be understood by those skilled in the art that various changes in form and details may be made therein without departing from the spirit and scope of the invention as defined by the appended claims.

As indicated above, the angle 62 defined between the face portion 53 and the planar surface of the body support portion 56 of the first mounting assembly portion 42-1 transitions from about 35° at the first end 112 to about 50° and the angle 62 defined between the face portion 53 and the planar surface of the body support portion 56 of the second mounting assembly portion 42-2 transitions from about 50° to about 65° at the second end 116. Such indication is by way of example only. In one arrangement, the angle 62 defined between the face portion 53 and the planar surface of the body support portion 56 of the first and second mounting assembly portions 42-1, 42-2 transitions between a subrange of angles within the 35° and 60° range. For example, in one arrangement, the angle 62 defined between the face portion 53 and the planar surface of the body support portion 56 of the first mounting assembly portion 42-1 transitions from about 45° at the first end 112 to about 50° and the angle 62 defined between the face portion 53 and the planar surface of the body support portion 56 of the second mounting assembly portion 42-2 transitions from about 50° to about 55° at the second end 116.

For example, as recited above, the set of knife assemblies 22 are utilized as part of disk flaker device. Such recitation is by way of example only. In one arrangement, a knife assembly 22 can be utilized as part of a canting head in a canting operation to remove material from opposing external surfaces of a log prior to sawing of the log into boards.

In another arrangement, a knife assembly 22 can be utilized as part of a chipper device. For example, in use, the chipper device can convert brush into small wood chips can convert waste-wood in sawmill, OSB, and/or plywood plants into small wood chips. Additionally, the knife assembly 22 can be utilized as part of a pulp chipper device to convert logs or whole trees into chips suitable for making pulp for the paper industry.

As indicated above, the FIGS. 7 and 8 illustrate the mounting assembly 42 having a first mounting assembly portion 42-1 and a second mounting assembly portion 42-2 mounted within the knife assembly securing mechanisms 24 in a side-by-side manner. Such illustration is by way of example only. In one arrangement, the mounting assembly 42 includes three or more separate mounting assembly portion where the angle 62 defined between the face portion 53 and the planar surface of the body support portion 56 transitions, along the longitudinal axis 54 of the mounting assembly 42, transitions from about 35° to about 65°.

What is claimed is:

1. A knife assembly, comprising:

a knife blade; and a mounting assembly for the knife blade, the mounting assembly having:

a knife blade support portion extending along a longitudinal axis of the mounting assembly, the knife blade support portion constructed and arranged to position a cutting edge of the knife blade distal to a leading edge of the mounting assembly, and a counter knife portion integrally formed with the knife blade support portion, the counter knife portion disposed at the leading edge of the knife blade support portion and defining a set back distance with the knife blade, the set back distance constructed and arranged to provide a travel path for a wafer, wherein the knife blade support portion defines a knife blade body support portion and a knife blade base support portion, the knife blade body support portion being substantially orthogonal to the knife blade base support portion, the knife blade body support portion and the knife blade base support portion extending along the longitudinal axis of the mounting assembly.

2. The knife assembly of claim 1, wherein the counter knife portion defines an angle of between about 35° and about 65° relative to a planar surface of the knife blade body support portion.

3. The knife assembly of claim 1, wherein:

the mounting assembly defines a set of openings within the knife blade body support portion and disposed along the longitudinal axis of the mounting assembly, each opening of the set of openings configured to align with an opening of a corresponding set of openings of a face gear of a disk flaker device; and the mounting assembly comprises a set of coupling mechanisms configured to insert within the openings defined by the mounting assembly and within the openings defined by the face gear of the disk flaker device, the coupling mechanisms being configured to secure the mounting assembly to the face gear.

4. The knife assembly of claim 3, wherein:

each coupling mechanism of the set of coupling mechanisms comprises a head portion, at least part of the head portion extending past the knife blade base support portion; and the knife blade defines a set of openings disposed along a longitudinal axis of a knife blade body portion of the knife blade, each opening at least partially surrounding the head portion of a corresponding coupling mechanism.

5. The knife assembly of claim 4, wherein each opening defined by the knife blade extends from the knife blade body portion to the knife blade base portion to define a slot-shaped opening.

6. The knife assembly of claim 1, wherein the counter knife portion has a face that defines a counter knife angle that transitions, along the longitudinal axis of the mounting assembly, from a first angle at a first end of the mounting assembly to a second angle at a second end of the mounting assembly relative to the planar surface of the knife blade body support portion.

7. The knife assembly of claim 6, wherein the counter knife angle defined by the face of the counter knife portion transitions from about 35° at the first end of the mounting assembly to about 65° at the second end of the mounting assembly.

8. The knife assembly of claim 1, wherein the knife blade comprises a body portion and a cutting portion disposed along a first edge of the body portion, the cutting portion being formed from a material having a hardness of at least about 60 HRC.

9. A disk flaker device, comprising:

a disk having at least one knife assembly securing mechanism; and a knife assembly carried by the at least one knife assembly securing mechanism, the knife assembly having a knife blade, and a mounting assembly for the knife blade, the mounting assembly having:

a knife blade support portion extending along a longitudinal axis of the mounting assembly, the knife blade support portion constructed and arranged to position a cutting edge of the knife blade distal to a leading edge of the mounting assembly, and a counter knife portion integrally formed with the knife blade support portion, the counter knife portion disposed at the leading edge of the knife blade support portion and defining a set back distance with the knife blade, the set back distance constructed and arranged to provide a travel path for a wafer, wherein the knife blade support portion defines a knife blade body support portion and a knife blade base support portion, the knife blade body support portion being substantially orthogonal to the knife blade base support portion, the knife blade body support portion and the knife blade base support portion extending along the longitudinal axis of the mounting assembly.

10. The disk flaker device of claim 9, wherein the counter knife portion defines an angle of between about 35° and about 65° relative to a planar surface of the knife blade body support portion.

11. The disk flaker device of claim 9, wherein:

the mounting assembly defines a set of openings within the knife blade body support portion and disposed along the longitudinal axis of the mounting assembly, each opening of the set of openings configured to align with an opening of a corresponding set of openings of a face gear of a disk flaker device; and the mounting assembly comprises a set of coupling mechanisms configured to insert within the openings defined by the mounting assembly and within the openings defined by the face gear of the disk flaker device, the coupling mechanisms being configured to secure the mounting assembly to the face gear.

12. The disk flaker device of claim 11, wherein:

each coupling mechanism of the set of coupling mechanisms comprises a head portion, at least part of the head portion extending past the knife blade base support portion; and the knife blade defines a set of openings disposed along a longitudinal axis of a knife blade body portion of the knife blade, each opening at least partially surrounding the head portion of a corresponding coupling mechanism.

13. The disk flaker device of claim 12, wherein each opening defined by the knife blade extends from the knife blade body portion to the knife blade base portion to define a slot-shaped opening.

14. The disk flaker device of claim 9, wherein the counter knife portion has a face that defines a counter knife angle that transitions, along the longitudinal axis of the mounting assembly, from a first angle at a first end of the mounting assembly to a second angle at a second end of the mounting assembly relative to the planar surface of the knife blade body support portion.

15. The disk flaker device of claim 14, wherein the counter knife angle defined by the face of the counter knife portion transitions from about 35° at the first end of the mounting assembly to about 65° at the second end of the mounting assembly.

16. The disk flaker device of claim 9, wherein the knife blade comprises a body portion and a first cutting portion disposed along a first edge of the body portion, the first cutting portion being formed from a material having a hardness of at least about 60 HRC.

17. A knife assembly, comprising:

a knife blade; and a mounting assembly having:

a knife blade support portion extending along a longitudinal axis of the mounting assembly, the knife blade support portion constructed and arranged to position a cutting edge of the knife blade distal to a leading edge of the mounting assembly, and a counter knife portion disposed at the leading edge of the mounting assembly and defining a set back distance with the knife blade, the set back distance constructed and arranged to provide a travel path for a wafer;

wherein the knife blade support portion defines a knife blade body support portion and a knife blade base support portion, the knife blade body support portion being substantially orthogonal to the knife blade base support portion, the knife blade body support portion and the knife blade base support portion extending along the longitudinal axis of the mounting assembly;

the mounting assembly defining a set of openings within the knife blade body support portion and disposed along the longitudinal axis of the mounting assembly, each opening of the set of openings configured to align with an opening of a corresponding set of openings of a face gear of a disk flaker device;

the mounting assembly comprises a set of coupling mechanisms configured to insert within the openings defined by the mounting assembly and within the openings defined by the face gear of the disk flaker device, the coupling mechanisms being configured to secure the mounting assembly to the face gear;

each coupling mechanism of the set of coupling mechanisms comprises a head portion, at least part of the head portion extending past the knife blade base support portion; and the knife blade defines a set of openings disposed along a longitudinal axis of a knife blade body portion of the knife blade, each opening at least partially surrounding the head portion of a corresponding coupling mechanism.

18. The method of claim 17, wherein an inner wall defining each opening of the set of openings being configures to substantially contact at least one lateral face of a set of lateral faces of each head portion of each coupling mechanism.

* * * * *